United States Patent [19]

Ahner et al.

[11] 4,353,688

[45] Oct. 12, 1982

[54] BAFFLE STRUCTURE FOR BLAST FURNACE STOVE

[75] Inventors: Walter D. Ahner, Murrysville, Pa.; James B. Malosh, Columbus, Ohio

[73] Assignee: United States Steel Corporation, Pittsburgh, Pa.

[21] Appl. No.: 243,015

[22] Filed: Mar. 12, 1981

[51] Int. Cl.[3] ..... C21B 9/00; F28C 3/10

[52] U.S. Cl. ..... 432/217; 431/170; 431/173; 431/182; 431/185

[58] Field of Search ..... 432/30, 216, 217, 218; 431/9, 170, 173, 176, 177, 182, 185

[56] References Cited

U.S. PATENT DOCUMENTS

| | | | |
|---|---|---|---|
| 3,887,134 | 6/1975 | Hacker | 431/170 |
| 3,891,384 | 6/1975 | Hovis et al. | 432/217 |
| 4,003,693 | 1/1977 | Straitz | 431/183 |
| 4,082,495 | 4/1978 | Lefebvre | 431/183 |

*Primary Examiner*—John J. Camby

*Attorney, Agent, or Firm*—John F. Carney

[57] ABSTRACT

A hot blast stove for use with high capacity blast furnaces incorporates a gas flow baffle particularly configured for improving mixture of combustion air and gas within the combustion chamber to enhance fuel burning characteristics with a concomitant reduction in pressure-pulsation experienced within the system and without an appreciable reduction in fuel firing rate.

9 Claims, 6 Drawing Figures

BAFFLE STRUCTURE FOR BLAST FURNACE STOVE

BACKGROUND OF THE INVENTION

In the operation of blast furnaces hot blast stoves are employed to heat pressurized air that is utilized in the ore reduction process. A mixture of gas and air for combustion is burned in the stoves in a combustion chamber in one part of the stove and the products of combustion passed through flues formed by refractory brick checkerwork in an adjacent part in which the heat is stored for subsequent transfer to the blast furnace process air.

Hot blast stoves of more recent design incorporate a combustion chamber containing a burner integrally formed in the lower end of the chamber to which gas and combustion air are separately conveyed and from which these elements are discharged in a manner to promote mixture for burning in the combustion chamber. Stoves of this type are exmplified by U.S. Pat. Nos. 3,627,284 and 3,642,262 to Van Laar, et al and Vroege, respectively.

As the size and capacity of blast furnaces have expanded, process air of higher temperatures has been required. This has necessitated greater firing rates in the hot blast stoves which the above cited equipment has been incapable of effectively delivering due to the poor air-gas mixing characteristics of the burner design. This deficiency in prior art equipment is compounded when effluent gas from the blast furnace is used as the fuel element since such gas has a relatively low heat content requiring greater amounts to be supplied to the burner in order to achieve the desired firing rates.

It is suggested in U.S. Pat. No. 4,054,409 to improve mixing by introducing the gas and combustion air to the burner through tangentially arranged ports in order to induce swirling of the fluids along concurrent flow paths thereby to improve combustion efficiency. This is not totally dispositive of the problem, however, since, when large amounts of gas, as are required when blast furnace gas is the fuel, are admitted to such burners, air-gas mixing is non-uniform and undesirable pressure pulsations occur in the combustion chamber. These pulsations may be of such magnitude as to cause serious damage to the stove lining, to the checkerwork and/or to the exterior piping and structural supports. To keep the pulsations within acceptable limits it has been required to restrict stove operation which, obviously, has an adverse affect on blast furnace process efficiency.

It is, accordingly, to the solution of such problems that the present invention is directed.

SUMMARY OF THE INVENTION

According to one aspect of the invention, therefore, there is provided a hot blast stove including a vertically extending shell divided into a vertically disposed combustion space and a space, parallel to said combustion space, containing refractory checkerwork, both of which spaces communicating at their upper ends for the flow of fluid through said stove, and a burner compartment substantially coaxially disposed in said combustion space at the lower end thereof, said burner compartment comprising an axially elongated flow passage communicating at its upper end with said combustion space; means for supplying gas to said flow passage adjacent the lower end thereof; means for supplying combustion air to said flow passage including a plurality of openings defining air ports adjacent the discharge end of said flow passage communicating substantially tangentially therewith; and a swirl-inducing baffle positioned across said flow passage intermediate the points of communication of said gas and combustion air supply means, said baffle being operative to induce a swirling motion in the gas flowing through said passage counter to that induced in the combustion air by said tangential air ports.

According to another aspect of the invention there is further provided a method for operating a hot blast stove having a vertically extending combustion space and a burner compartment at the lower end of said combustion space, said burner compartment containing a flow passage in open generally coaxial communication with said combustion space, comprising the steps of introducing gas and air for combustion to said flow path at longitudinally spaced locations therealong; inducing a spinning motion in the air flow system in said flow passage; and inducing a spinning motion in said gas stream in said flow passage that are directionally counter to those induced in said air stream.

It is, accordingly, a principal object of the invention to provide a hot blast stove for a blast furnace system and a method for operating a hot blast stove that avoids, or significantly reduces, the danger of establishing pressure pulsations of damaging proportions within the interior of the stove.

It is another object of the invention to provide a hot blast stove and a method of operating the same that enables the use of large amounts of gas having a relatively low heat content to produce the firing rates necessary for operating high capacity blast furnace systems.

For a better understanding of the invention, its operating advantages and the specific objectives obtained by its use, reference should be made to the accompanying drawings and description which relate to a preferred embodiment thereof.

DESCRIPTION OF THE PREFERRED EMBODIMENT

Figure 1:
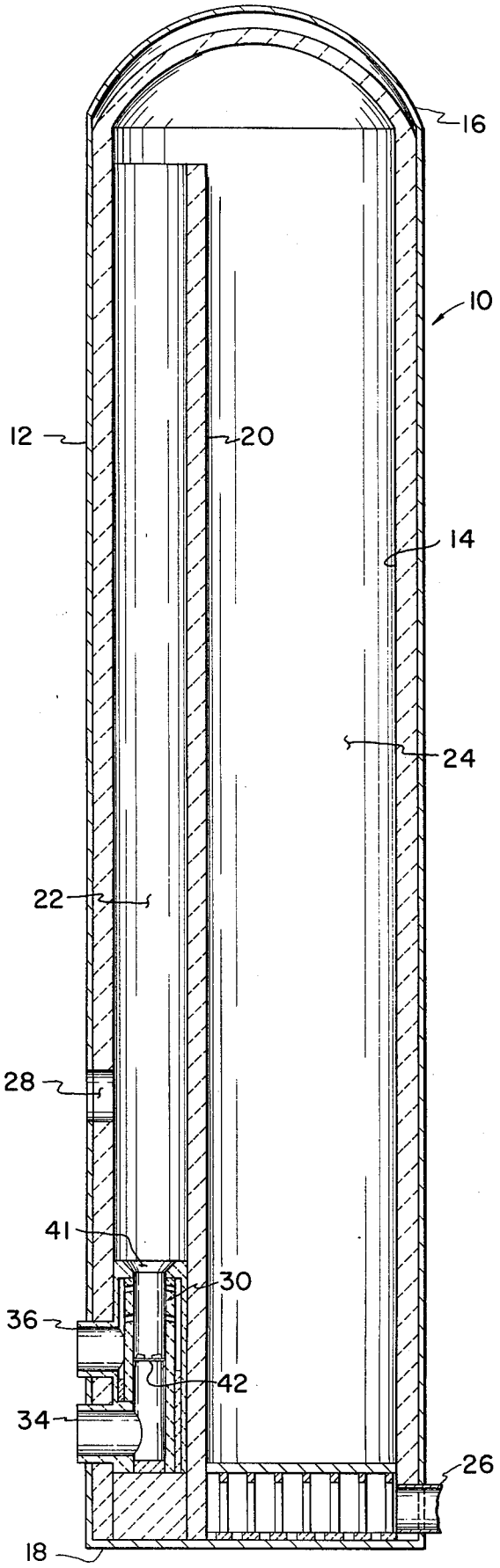
FIG. 1 is an elevational section of a hot blast stove incorporating the present invention.
Figure 2:
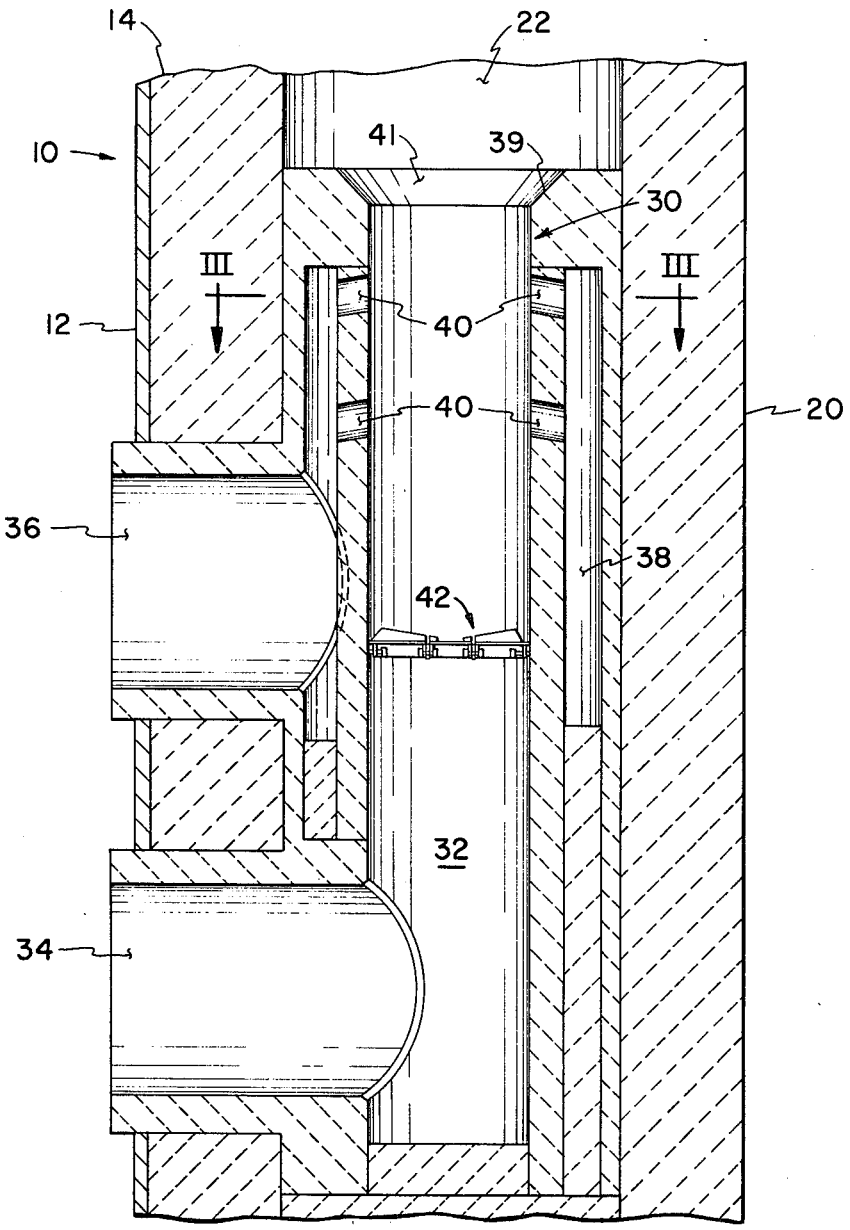
FIG. 2 is an enlarged elevational section of the burner portion of the hot blast stove of FIG. 1.
Figure 6:
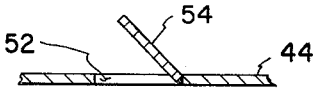
FIG. 6 is a partial sectional view along line 6—6 of FIG. 4.
Figure 3:
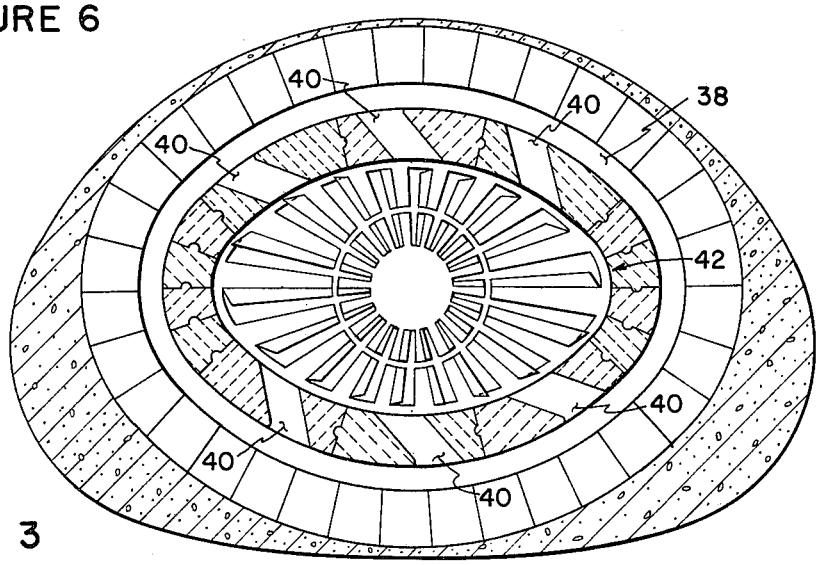
FIG. 3 is a plan section taken along line 3—3 of FIG. 2.
Figure 4:
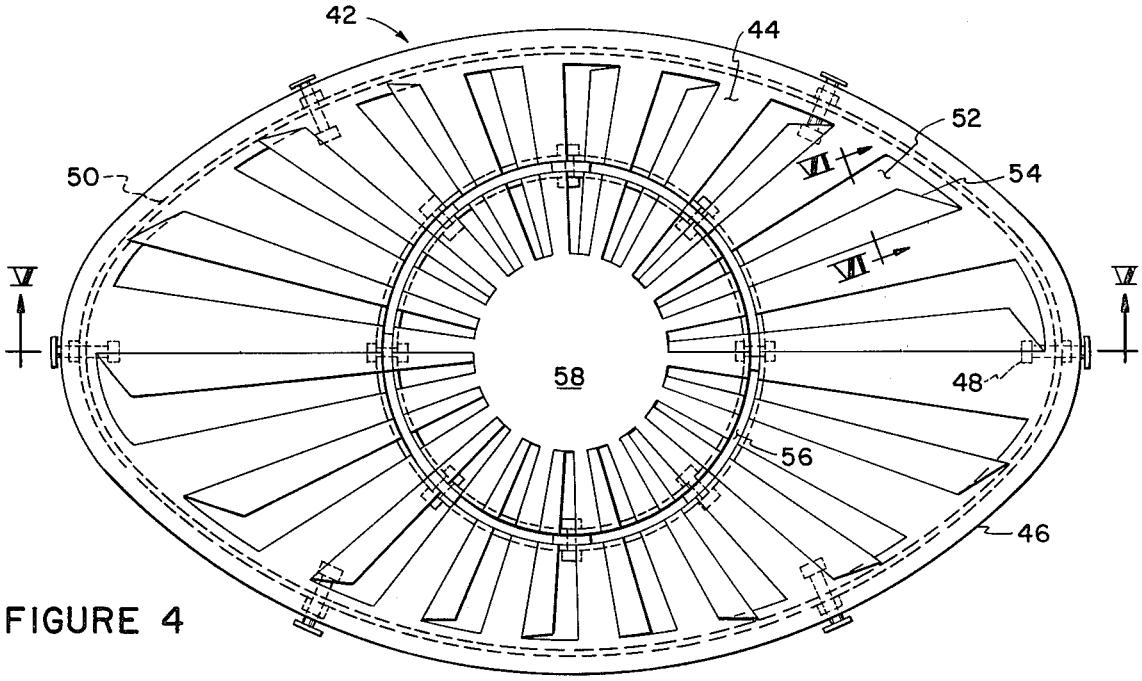
FIG. 4 is a plan view illustrating a gas baffle constructed according to the invention.
Figure 5:
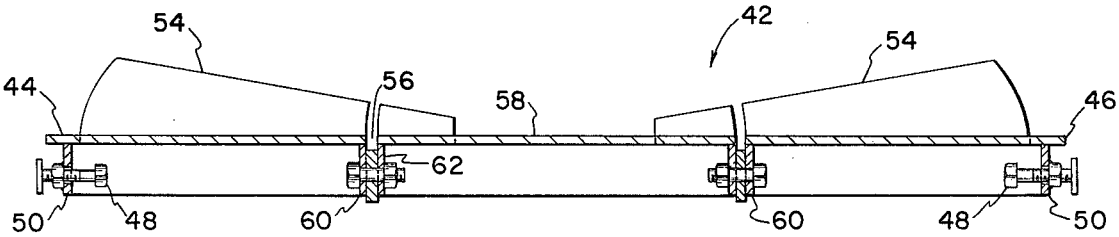
FIG. 5 is an elevational section along line 5—5 of FIG. 4.

FIG. 1 of the drawing illustrates a hot blast stove 10 for use with blast furnaces constructed according to the invention. It broadly comprises a generally cylindrical upstanding shell 12 having a refractory lining 14. The shell 12 has a domed top 16 and a floor 18 that close the opposite ends thereof. Within the shell 12 is a refractory partition 20 that divides the shell interior into a vertically elongated combustion space 22 that is generally elliptical in section and a checker chamber 24 that occupies the remainder of the shell. The upper end of the partition 18 is longitudinally spaced from the shell top 16 so as to place combustion space 22 and checker chamber 24 in mutual fluid communication.

Although not shown as it is well known and not germane to the present invention, the checker chamber 24 is filled with refractory checkerbrick forming flues through which fluid passing through the stove is caused to flow. In one operational phase of the stove hot products of combustion from the combustion space 22 flow downwardly through the checkerbrick exiting at the bottom through an outlet (not shown). The checkerbrick is thus heated such that, during an alternate operational phase, the contained heat is transferred to cold blast furnace process air that is admitted at the bottom of the chamber through inlet 26 and flows in a direction opposite that of the flow of combustion products to exit the stove at outlet 28 which is connected with the blast furnace by an appropriate connection (not shown).

The combustion space 22, at its lower end, contains a vertically elongated burner compartment 30 that is in open, generally coaxial alignment with the combustion space. As shown, the burner compartment 30 is provided with a generally elliptical, axially elongated flow passage 32 at the lower end of which a gas inlet 34 communicates for the supply of fuel to the stove. Combustion air enters the stove through a supply inlet 36 spaced above gas inlet 34 and connects with an annular manifold 38 that concentrically encloses the flow passage 32 within the wall of the burner compartment 30. The compartment 30 contains a discharge opening 40 formed by a conical surface 42 that diverges from the flow passage 32 into the combustion space 22.

A plurality of openings 43, defining air ports, penetrate the compartment wall adjacent the discharge opening 40 and supply combustion air into the flow passage 32. The openings 43, here shown as being in two vertically spaced groups, are circumferentially spaced about the compartment wall and communicate with the flow passage substantially tangentially therewith so as to induce a swirling or rotary motion to the air admitted to the compartment.

According to the present invention, there is provided in the burner compartment flow passage 32, a swirl-inducing baffle, indicated generally as 45, that operates to rotate the gas stream as it flows through the flow passage and in a direction counter to the rotary motion imparted to the combustion air stream by a tangential inlet ports 43. The baffle 45 is formed as a generally flat metal plate 46 and is positioned in the flow passage 32 at a location intermediate the points of communication of the gas and combustion air inlets therewith. The plate 46 has a generally elliptical peripheral edge 47 that conforms with the transverse shape of the flow passage 32 such that, when mounted therein the plate edge is in close proximity or abutting the flow passage wall about its full circumference. Mounting is effected by a plurality of threaded cap screws 48 that penetrate threaded openings in a flange 50 that depends from, and is coextensive with, the plate edge 47.

Baffling of the gas flow is effected by a plurality of radially extending openings 52 that penetrate the plate 46 and by vanes 54 associated with each of the openings. As shown, the openings 52 have divergent sides such that the flow area presented by the openings increases proportionately away from the mid-region of the plate. Each vane 54 is disposed along that side edge of the respective openings 52 and inclined in a direction that will impart a rotary motion to the gas flowing through the openings that is counter that of the direction of swirl induced in the combustion air stream.

The plate 46 may, as shown, be formed with a central opening 56 defining a manway, which opening is closed by a removable cover 58 boltedly attached between mating flanges, 60, 62, respectively, that depend from the plate and cover.

It will be appreciated that the present invention is operative to effect mixing of the gas and combustion air substantially totally within the burner compartment 30 and prior to their entry into the combustion space 22. By locating the air inlet ports 43 upstream in the fluid flow sense from the discharge opening 40 and the baffle 45 upstream of the ports mixing of the two fluids is enhanced as it is caused to occur in the confined space defined by the wall of the flow passage 32. Mixing is further enhanced by the fact that the incoming combustion air enters the flow passage 32 over an axially elongated region due to the longitudinal spacing of the groups of the air inlet ports 43.

Accordingly, through use of the invention described herein the gas and combustion air admitted to the combustion space 22 is thoroughly mixed prior to ignition such that combustion that occurs in the space is devoid of significant amounts of the pressure pulsations attendant with the use of prior art burner arrangements. Because of the mixing efficiency of the described arrangement gas having a relatively low heat content, such as the effluent from an associated blast furnace, can be utilized for firing in the hot blast stove. Such gas, which must be introduced in amounts significantly greater than enriched gas, can be effectively burned without danger of producing the damaging pulsations referred to heretofore.

It will be understood that various changes in the details, materials and arrangements of parts which have been herein described and illustrated in order to explain the nature of the invention, may be made by those skilled in the art within the principle and scope of the invention as expressed in the appended claims.

What is claimed is:

1. A hot blast stove including a vertically extending shell divided into a vertically disposed combustion space and a space, parallel to said combustion space, containing refractory checkerwork, both of which spaces communicating at their upper ends for the flow of fluid through said stove, and a burner compartment substantially coaxially disposed in said combustion space at the lower end thereof, said burner compartment comprising:

(a) an axially elongated flow passage communicating at its upper end with said combustion space;

(b) means for supplying gas to said flow passage adjacent the lower end thereof;

(c) means for supplying combustion air to said flow passage including a plurality of openings defining air ports adjacent the discharge end of said flow passage communicating substantially tangentially therewith; and (d) means for inducing a swirling motion in the gas flowing through said passage counter to that induced in the combustion air by said tangential air ports, said means including:

(i) a baffle plate disposed transversely of said flow passage intermediate the points of communication of said gas supply means and said combustion air supply means;

(ii) a plurality of through-openings in said plate; and (iii) means associated with said openings for directing the gas flowing therethrough tangentially in a direction opposite to that induced in the combustion air by said air ports.

2. A burner compartment according to claim 1 in which the means for directing gas through said plate openings is a vane associated with each opening inclined upwardly with respect to said plate in a direction opposite to the direction of inclination of said air ports.

3. A burner compartment according to claim 2 in which said openings are circumferentially spaced about the axis of said flow passage and emanate substantially radially therefrom.

4. A burner compartment according to claim 3 in which the flow area presented by the radial openings increases in proportion to the radial distance from the center of the plate.

5. A burner compartment according to claim 1 in which said combustion air supply means includes an inlet manifold concentrically disposed about said flow passage, and in which said air ports interconnect said manifold with said flow passage at circumferentially spaced locations thereabout.

6. A burner compartment according to claim 5 in which said air ports are arranged in axially spaced groups along said flow passage.

7. A burner compartment according to claim 1 having a discharge opening at its upper end formed a divergent conical surface.

8. A burner compartment according to claim 1 in which the plate forming said baffle includes a plurality of circumferentially spaced, radially extending jam bolts for removably attaching said baffle in said burner compartment flow passage.

9. A burner compartment according to claim 1 in which the plate forming said baffle includes a central opening forming a manway and a removable closure closing said manway.

* * * * *